US006360376B1

(12) United States Patent
Carrington

(10) Patent No.: US 6,360,376 B1
(45) Date of Patent: Mar. 26, 2002

(54) PROTECTIVE HAT

(75) Inventor: Janice Carrington, Valley Forge, PA (US)

(73) Assignee: Plum Enterprises, Inc., Valley Forge, PA (US)

( * ) Notice: Subject to any disclaimer, the term of this patent is extended or adjusted under 35 U.S.C. 154(b) by 0 days.

(21) Appl. No.: 08/827,659

(22) Filed: Apr. 10, 1997

(51) Int. Cl.[7] ..... A42B 3/00
(52) U.S. Cl. ..... 2/412; 2/411
(58) Field of Search ..... 2/410, 411, 412, 2/414, 417, 418, 425, 205, 209.5, 209.7, 182.8, 181.6, 182.3, 183

(56) References Cited

U.S. PATENT DOCUMENTS 2,717,384 A * 9/1955 Frothingham ..... 2/414
3,171,133 A * 3/1965 Steffen ..... 2/414
4,446,576 A * 5/1984 Hisataka ..... 2/425
4,581,773 A * 4/1986 Cunnane ..... 2/204
4,916,759 A * 4/1990 Arai ..... 2/414
5,343,569 A * 9/1994 Asare et al. ..... 2/412
5,461,730 A * 10/1995 Carrington ..... 2/411
5,930,841 A * 8/1999 Lampe et al. ..... 2/411
5,943,706 A * 8/1999 Miyajima et al. ..... 2/412

* cited by examiner

*Primary Examiner*—Michael A. Neas
(74) *Attorney, Agent, or Firm*—Drinker Biddle & Reath LLP

(57) ABSTRACT

A protective hat having shock absorptive and insulating properties includes a head-receiving member adapted to overlie and protect least the sides, top and rear of the head of a wearer. The head-receiving member includes a core of resilient shock absorbent polymeric foam material and a shell of textile fabric material wherein the shell is constructed and arranged to fully enclose and encapsulate the core so that the hat has a conventional appearance and surface texture. The core is provided with first and second core layers. The first core layer is formed of a substantially soft closed cell foam material having a thickness of about ⅛ to about ¾ inch. The second core layer is formed of a substantially hard closed foam material having a thickness of about ⅛ to about ⅜ inch. The core has spaced holes therethrough distributed over the surface of the core to facilitate ventilation of the concavity. The core also has a plurality of slits therethrough wherein the slits are disposed between the holes to facilitate conformity of the core to the shape of the head of the wearer and to further facilitate ventilation of the concavity.

8 Claims, 4 Drawing Sheets

FIG. 6
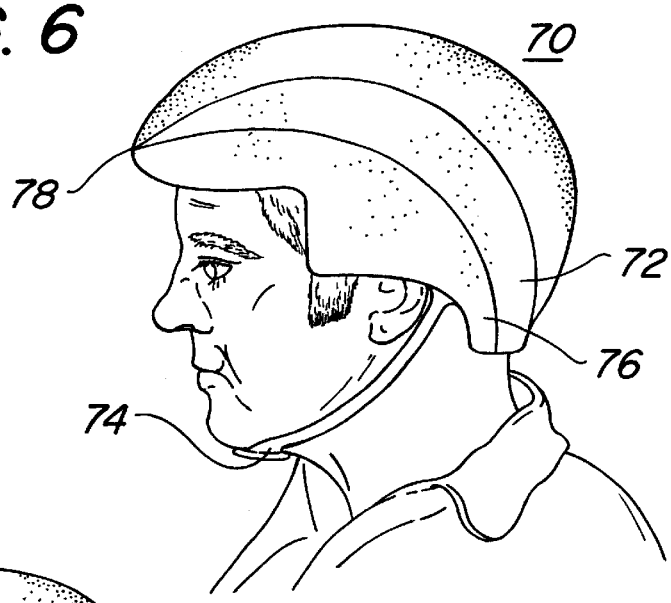
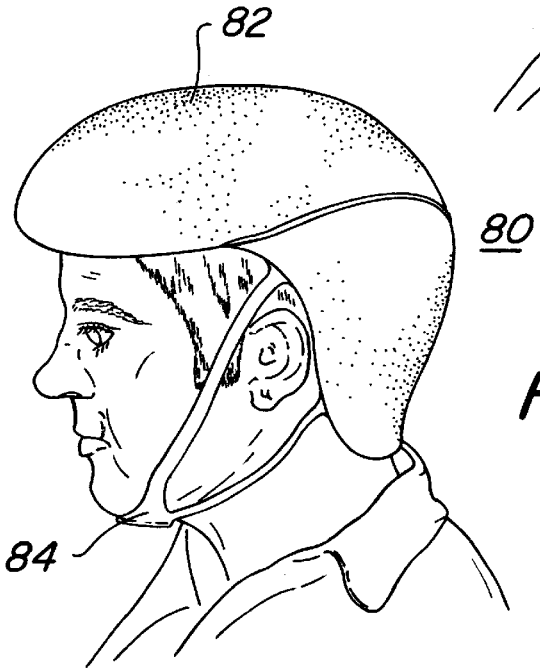
FIG. 7
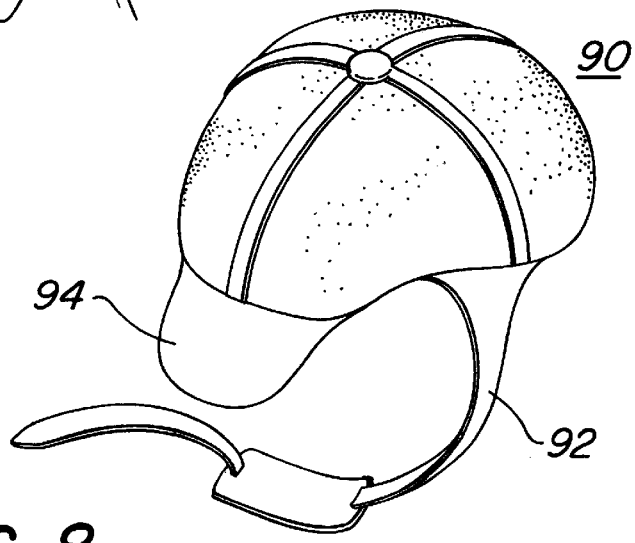
FIG. 8

FIG. 9
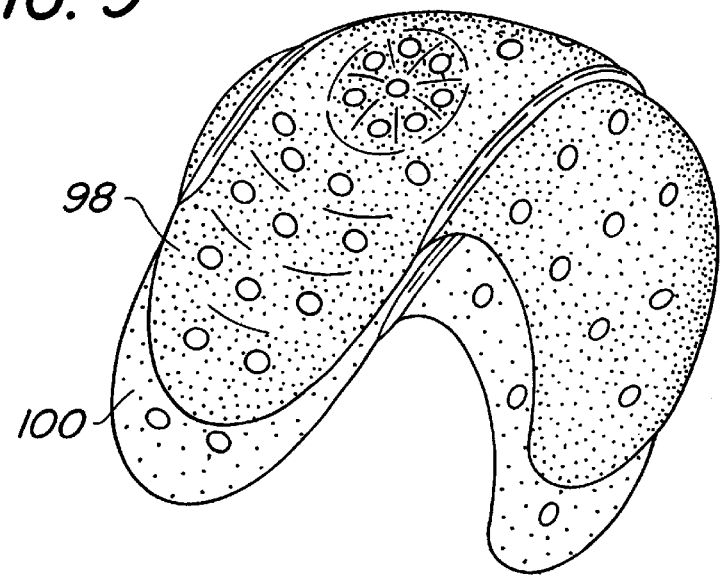
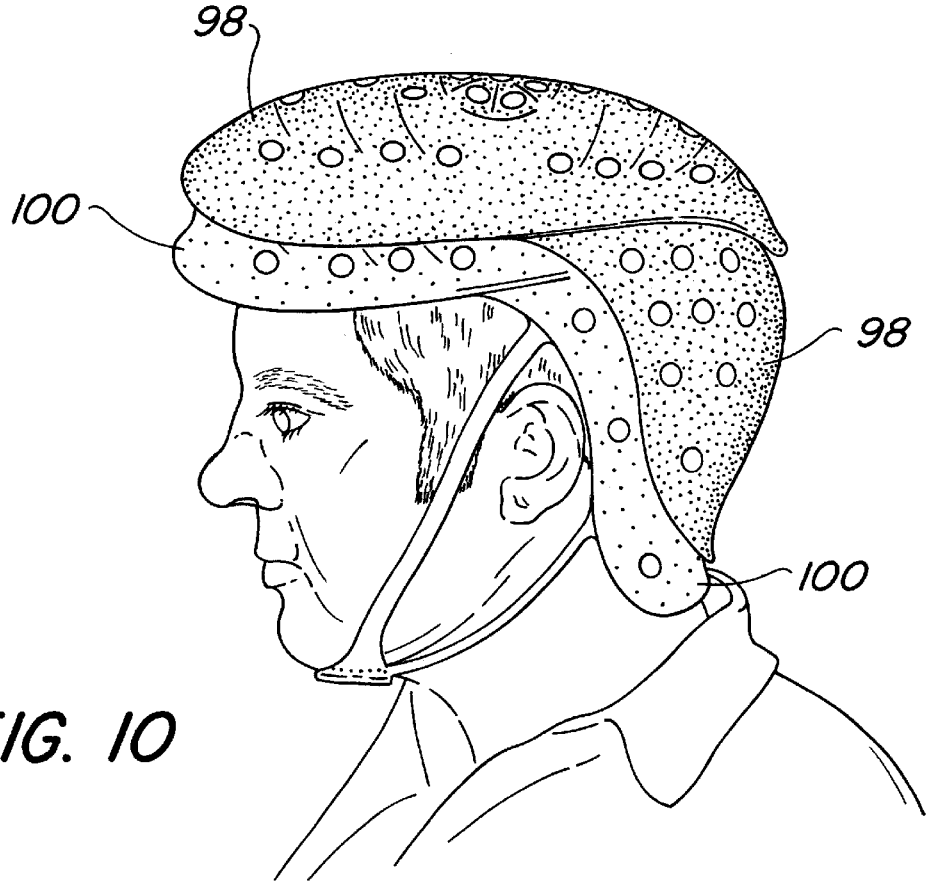
FIG. 10

PROTECTIVE HAT

BACKGROUND OF THE INVENTION

This invention relates to protective headwear, and more specifically, to protective headwear suitable for use as a substantially hard helmet.

Numerous kinds of protective headwear have heretofore been proposed. Such headwear, for example, the protective helmet shown in U.S. Pat. No. 3,171,133, issued Mar. 2, 1965, to Steffen, was often quite unconventional in appearance and objectionable for that reason alone.

Attempts have been made to provide combined dress and protective headwear, usually for children. For example, in U.S. Pat. No. 2,717,384, issued Sep. 13, 1995, to I. Frothingham, a combined dress and protective hat was proposed which included a circular cap, constructed over a cruciform framework of protective elements. This device, too, differed greatly in appearance from conventional headgear, and revealed itself at once to be a specially constructed protective device.

In my U.S. Pat. No. 4,581,773, issued Apr. 15, 1986, I described two embodiments of a protective hat, specifically intended for infants and toddlers, which provided a conventional and unobjectionable appearance, while also comfortably providing a protective function. The hat of that patent was constructed using components made up of cores of resilient shock absorbent foam material, encapsulated in fabric shells.

In attempting to apply the principles of my U.S. Pat. No. 4,581,773 to protective hats for larger sizes, such as for children four years of age and older, adolescents and adults, it was found that simply enlarging the hat and providing thicker foam was not a practical solution. On the contrary, it has been found that use in the patented construction of core elements in excess of about ⅜ inch in the thickness produced a hat difficult to shape to the head of a wearer, uncomfortable to wear due to poor ventilation, and difficult to fabricate. Therefore it was desirable to provide an easily manufactured protective hat suitable for use by older children, adolescents and adults.

My U.S. Pat. No. 5,461,730 addressed this problem by providing a protective hat which comprised a head-receiving member which overlaid and protected at least the sides, top and rear of the head of a wearer, the head-receiving member comprising a core of resilient shock absorbent polymeric foam material and a shell of textile fabric, so constructed as to have the appearance of a conventional hat. The core was so configured and constructed that it readily conformed in use to the head of the wearer, and provided adequate ventilation while also providing enhanced impact protection.

In a preferred form of the headwear taught in this patent the head-receiving member was fabricated from three subassemblies, one an arcuate member which partly encircled the head of a wearer, disposed in the direction of the medial plane of the head, and side pieces which enclosed the sides of the head, preferably covering the temple, ears and a portion of the lower jaw of the wearer. Edge portions of the side pieces were complementary with and coupled to respective edge portions of the arcuate member. Together, the arcuate member and the side members formed a concavity adapted to receive the head of a wearer. The arcuate member and the side pieces had an inner core, comprising a layer of impact absorbent foam material, preferably of the closed-cell type, fully enclosed within a shell of textile fabric to give the article a conventional appearance and feel.

These prior art helmets were relatively soft helmets providing all of the advantages of soft helmets while avoiding the disadvantages of harder helmets, which can be heavy and uncomfortable next to the head of a user. However, it would be desirable to bridge the gap between hard and soft helmets and provide the advantages of each while avoiding the disadvantages of both.

SUMMARY OF THE INVENTION

A protective hat having shock absorptive and insulating properties includes a head-receiving member adapted to overlie and protect at least the sides, top and rear of the head of a wearer. The head-receiving member includes a core of resilient shock absorbent polymeric foam material and a shell of textile fabric material wherein the shell is constructed and arranged to fully enclose and encapsulate the core so that the hat has a conventional appearance and surface texture. The core is provided with first and second core layers. The first core layer is formed of a substantially soft closed cell foam material having a thickness of about ⅛ to about ¾ inch. The second core layer is formed of a substantially hard closed foam material having a thickness of about ⅛ to about ⅜ inch. The core has spaced holes therethrough distributed over the surface of the core to facilitate ventilation of the concavity. The core also has a plurality of slits therethrough wherein the slits are disposed between the holes to facilitate conformity of the core to the shape of the head of the wearer and to further facilitate ventilation of the concavity.

BRIEF DESCRIPTION OF THE DRAWINGS

FIGS. 6, 7 and 8 are alternate embodiments of the protective hat of FIG. 4;

FIGS. 9 and 10 are views of the dual foam structure of the present invention.

DETAILED DESCRIPTION OF THE INVENTION

Figure 1:
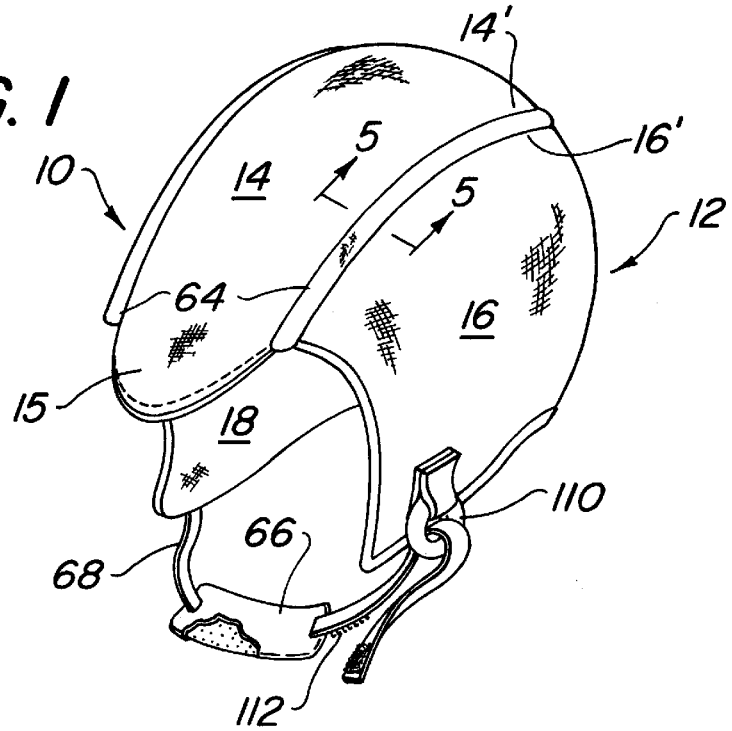
FIG. 1 is a perspective view of a protective hat.

Referring now to the drawings in detail, wherein like reference numerals indicate like elements, there is seen in FIG. 1 a protective hat designated generally by the reference numeral 10. The protective hat 10 comprises a head enveloping member, designated generally by the reference numeral 12, which may also be referred to as a crown. The head enveloping member 12 is adapted to overlie and protect at least the sides and top of the head of a wearer.

The head-enveloping member 12 includes an arcuate member 14, which covers and protects the head of a wearer from a forwardly projecting tip 15 disposed just above the eyebrows to the nape of the neck. The arcuate member 14 extends, in general, in the direction of the medial plane of the head. The head enveloping member 12 also includes side pieces 16 and 18, joined to the arcuate member 14 in a manner shown below.

The arcuate member 14 and side pieces 16, 18 together form a concavity, closed on three sides and at the top, which may be placed over the head of the wearer. The side pieces 16 and 18 are so arranged with respect to the arcuate member 14 that edge portions of the side pieces 16 and 18, such as the edge portion 16' in FIG. 1, are complementary with and coupled to respective edge portions of the arcuate member 14 such as the edge portion 14' in FIG. 1.

Figure 4:
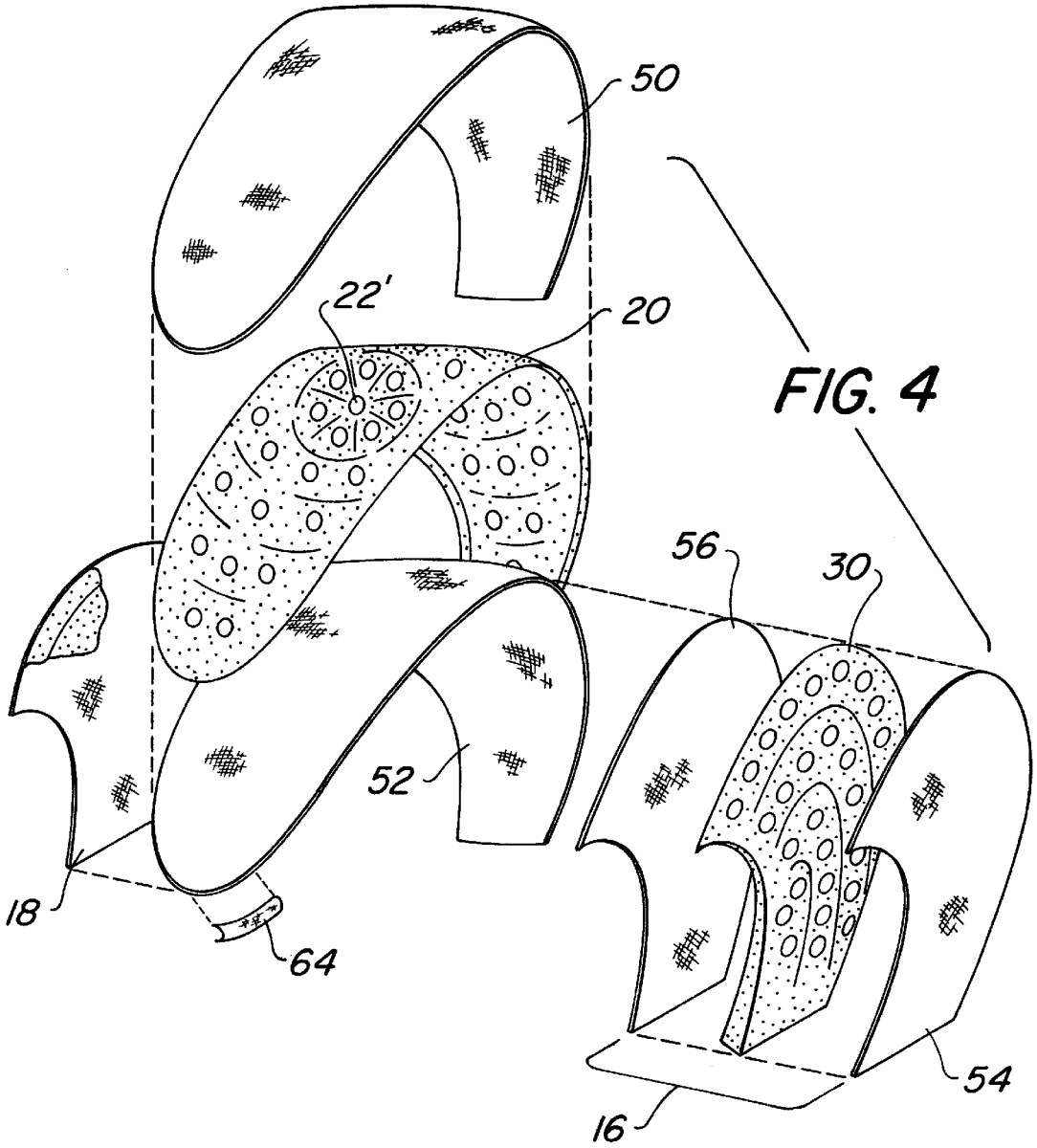
FIG. 4 is an exploded view, showing details of the construction of a hat in accordance with the embodiment of FIG. 1.

The arcuate member 14 and side pieces 16 and 18 of the head enveloping member 12 can include a resilient shock absorbent core of plastic polymeric material, enclosed in a shell preferably of textile fabric material, as shown in FIG. 4, less desirably, the shell may be of other materials, such as plastic polymeric sheet.

Figure 2:
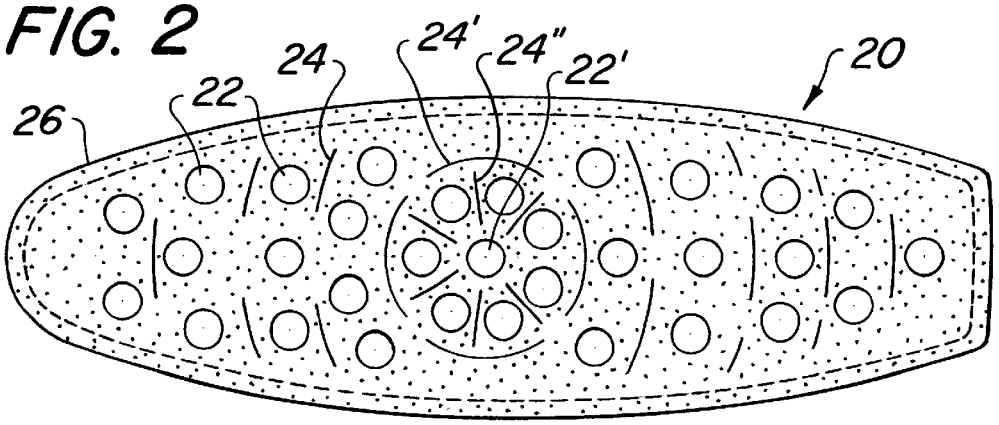
FIG. 2 is a plan view of a core element used in the protective hat of FIG. 1.
Figure 3:
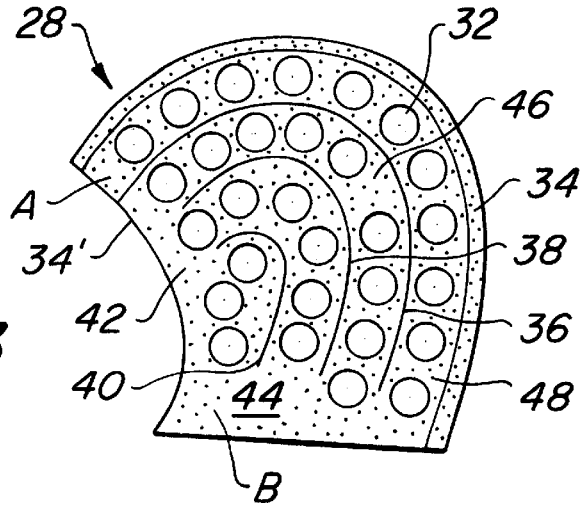
FIG. 3 is a plan view of another core element used in the protective hat of FIG. 1.

FIG. 2 illustrates a form of a core that can be used for the head-enveloping member of crown 12. The core 20 comprises an initially flat sheet of shock absorbent and thermally insulating material, which may be cut or die stamped to shape from a flat sheet of raw material. The core 20 is perforated, as by holes 22, to enhance the vapor permeability of the finished hat 10, and is also be perforated, as by the illustrated slits 24. The edges 26 of the core 20 can be beveled as shown in FIG. 4, for a purpose described below, and the shape of the core 20 is such as to facilitate assembly of the head-enveloping member 12 and side pieces 16 and 18. The side pieces 16 and 18 have cores 28 and 30, which may be cut or die stamped from a sheet of suitable material, for example, the kind of material forming the core 20. Referring now to FIG. 3, like the core 20, the cores 28 and 30 (of which the core 28 is seen in FIG. 3) may be provided with holes 32, which serve to provide ventilation as do the above-mentioned holes 22 of the core 20. The edges of the cores 28 and 30 may be beveled, as at 34, complementary with the beveled edges 26 of the core 20. The cores 28 and 30 are also provided with slits 36, 38 and 40, like the above-mentioned slits 24, the purposes of which will be explained below.

Referring again to FIG. 2, it will be seen that the holes 22 in the core 20 can be arranged in what may be described as roughly in arcs about what may be considered a central hole 22'. The slits 24 are arcuate and are for the most part cut widthwise of the member 14 and roughly parallel to the arcs of the holes 22 to which they are closest. The slits around the central hole 22' comprise arcuate segments 24' generally surrounding the central hole 22', and radial segments 24" extending outwardly from the central hole 22'. The slits 24, and to a lesser extent, the holes, facilitate conformity of the initially flat core 20 to the compound curvature of the head of a wearer. They also enhance ventilation.

Referring now to FIG. 3, it will be understood that the core 28 depicted can be the core associated with the side piece 18. The core 30 associated with the side piece 16 can be similarly configured, but beveled on the opposite face (see FIG. 4).

The cores 28 and 30, and hence the side pieces 16 and 18 with which they are associated, are shaped to include a zone A, projecting forwardly when the hat 10 is operatively disposed so that it overlies and fully protects the temple of the wearer. The cores 28 and 30 also include a zone B which overlies and protects a portion of the lower jaw of the wearer when the hat 10 is operatively disposed. The lower edge of the core 28 is preferably generally horizontally oriented, to maximize protection of the jaw. It should be apparent that the slits 36,38 and 40 are of a curved contour, spaced from each other, and cut in the illustrated embodiment so that the slit 36 is roughly parallel to the edge 34. The slits 36, 38 and 40 may be described for convenience as nested curves, generally parallel to one another in the sense that they do not intersect or sharply converge their respective lengths. The areas bounded by and within the curves defined by the respective slits 36, 38 and 40 may, when the hat 10 is fitted to the head of a wearer, be offset to permit the cores 28 and 30 (and subsequently the side pieces 16 and 18) to take on compound curves, enabling the side pieces to conform to the head of the wearer. The shape and orientation of the larger slits 38 and 40 are preferably such that at least one of the slits 38 and 40 in part surrounds the ear of user of the hat 10. The slits 36, 38 and 40 and the holes 32 allow for better hearing through the hat 10 and for the presence of hearing aids. The slit 40, farthest from the edge 34, takes the form of a relatively small radius, and forms a tab-like zone or region 42. The area between the slits 40 and 38 forms a zone or region 44, and the area between the slits 38 and slit 36 forms a zone or region 46. The area between the slit 36 and the edge 34 of the side piece 16 may be said to form a zone or region 48.

In an illustrated form of the side piece 16, the holes 32 in the zone or region 48 form an arc generally parallel to the contour of the edge 34. The holes 32 in the zone or region 46 likewise form an arc generally parallel to the contour of the edge 34. The holes in the zone or region 44 follow the contour of that zone or region, and the holes in the zone or region 42 include holes which, together with holes disposed in the other regions, form an arc generally parallel to the front edge 34' of the side piece 16. Another hole is disposed generally at what may be considered a focal point of the small-radius arc defined by the slit 40. Other arrangements of slits and holes may of course be used.

Referring now to FIG. 4, it will be seen that the core 20 is enclosed by fabric shell pieces 50 and 52, which are eventually stitched together around their peripheries outside the periphery of the core 20. The cores 28 and 30 are preferably enclosed in a similar manner. Thus, referring again to FIG. 4, an outer shell piece 54 and an inner shell piece 56 are associated with the core 28. Like the above-described shell pieces 50 and 52, the shapes of the respective shell pieces 54 and 56 approximate the shape of the core with which they are associated, in this instance the core 30. The outer shell piece 54 and inner shell piece 56 are stitched together around the periphery and outside the periphery of the core 30.

The material from which the shell pieces 50, 52, 54 and 56 are made may be any suitable fabric. In one presently preferred form of the invention, the material used for the shell pieces is a broadcloth of 65% polyester and 35% cotton. Such a material provides a desirable degree of durability and soil resistance, as well as an acceptable feel and conventional appearance. It has been found desirable to cut the inner shell pieces on the bias, whereas the outer shell pieces are advantageously straight of grain. Water-resistant nylon and other fabrics or materials may be used depending upon the desired application.

Referring now to FIG. 4, the shell which encloses the cores 20 and 30 are described in greater detail. An outer shell piece 50 provides the outer surface of the top of the head enveloping member 12, and an inner shell piece 52, provides an inner lining of the top portion of the head enveloping member 12. The outer and inner shell pieces 50 and 52 are cut or stamped to a shape somewhat similar to the shape of the core 20, but somewhat larger, and they are stitched to each other around their peripheries outside the peripheral edge of the core 20. When such stitching is completed, the outer and inner shell pieces 50 and 52 fully enclose and encapsulate the core 20 so that the outer surfaces of the protective hat 10 have a conventional appearance and texture imparted by the material of the shell pieces 50 and 52.

As in the case of the core 20, the core 21 enclosed and encapsulated in a suitable shell of fabric.

Figure 5:
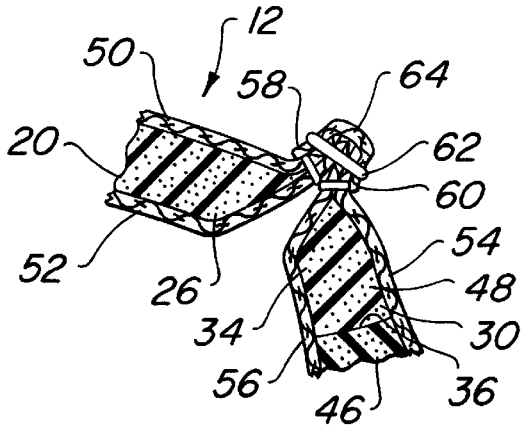
FIG. 5 is a partial cross-sectional view, taken along the line 5—5 in FIG. 1, and showing a construction detail of the hat in accordance with FIG. 1.

FIG. 5 shows a construction detail of a protective hat in accordance with the above description while FIGS. 6, 7 and 8 show alternate embodiments of the hat of FIG. 5. FIG. 5 illustrates the assembled relationship among the cores 20 and 30 and the fabric shell pieces 50 and 52 and 54 and 56, respectively. It also illustrates the manner in which the head-enveloping member 12 and side pieces 16 and 18 may be assembled and the manner in which the cores can conform to the head of the wearer. Referring again to FIG. 5, it will be seen that the respective outer shell piece 50 and inner shell piece 52, and outer shell piece 54 and inner shell piece 52, when sewn together around the peripheries of their respective cores 20 and 30, provide small areas of salvage 58, 60 which facilitate their being stitched together as at 62, to construct the head-enveloping member 12. The beveled edges 26 and 34 of the cores 20 and 30 provide in effect, a mitre, allowing for an angled corner. A variety of stitching and finishing techniques may occur to those skilled in the art, but it is believed that the salvage of the shell pieces 50 and 52 and the salvage of the outer shell pieces 54 and 56 should be joined by a line of stitching 62, and that binding material 64 should be used to pipe or finish the edge. The binding material may be cotton or cotton-poly interlock knit or other suitable material.

Protective hat 70 is an alternate embodiment wherein region 76 of head-receiving portion 72 is cut so as to uncover a portion of the ear of the wearer in order to permit the wearer to hear better. Flat 70, having chin strap 74, can be assembled in four pieces rather than three in order to provide a more conventional apppearance. Protective hat 80, also having a chin strap 84, is another alternate embodiment with a differently shaped head-receiving portion 82. Protective hat 90, having chin strap 92, is provided with a visor 94 for protecting the eyes of the wearer from the sun. Loops can be constructed within protective hat 70, 80 and 90 to secure eyewear, for example, with a hook- and loop-type fastening such as Velcro®.

The cores 20 and 28 are ideally made from dimensionally stable, chemically inert, highly impact resistant material. One suitable material, which is presently used is sold by Uniroyal, Inc. under the trademark Ensolite, type AA. It comprises a closed cell foam of specially modified PVC with nitrile rubber. The material is a cross-linked polymer capable of withstanding repeated impact/recovery cycles, and has a density of between about 4.0 and 6.0 lbs./cu. ft., a thermal conductivity of 0.26, a 25% compression resistance of 5.0 to 7.0 psi at 70° F., a 50% compression set, maximum, of 12.0%, a maximum linear shrinkage of 3.0%. a minimum tensile strength of 100 lb./sq. in. and a minimum cold crack of 10 degrees F. Other equivalent foams can be used. The cores 20 and 28 can have thicknesses of about ⅜ inch to 1 inch, as is explained below.

It has been found that in constructions in accordance with the invention, for sizes appropriate for children age 4 through 7, the thickness of the foam is preferably in the range of ⅜ to ½ inch, and the holes in the cores approximately ⅜ inch in diameter. For children ages 7 through 12 years, the thickness of the foam is preferably from ½ to ¾ inch, and the holes in the cores approximately ii inch diameter. For adult sizes, the thickness of the foam is preferably in the range of ⅝ to 1 inch, and the holes in the cores approximately 9⁄16 inch in diameter.

A suitable chin strap 68, O-ring 110 or other means of securement may be provided to secure the hat 10 to the head of a wearer. For example, referring to FIG. 1, the illustrated chin strap 68 may be passed through a light weight unbreakable plastic O-ring 110, and secured to itself by self-adhering fasteners 112 of the VELCRO type. Other arrangements will occur to those skilled in the art. The chin strap 68 may be of cotton or polycotton interlock knit fabric or other suitable material. As may be seen in FIG. 1, a chin guard 66 may be associated with the chin strap 68, for added chin protection and wearer comfort. The chin guard 66 (shown partly broken away in FIG. 1) may be made of foam like that of the cores 20, 28 and 30, of suitable thickness appropriate to the intended user, and covered with a shell of fabric to match the fabric of the above-described shell pieces. Other arrangements may be used.

The embodiments thus described have been found to be useful in numerous applications for children. Among these are: postsurgery protection, and protection from head trauma in cases of physical or emotional disability. The invention is also of use in preventing or moderating head injuries in play activities such as sledding and skiing, and it has been found that the flotation property of the closed cell foams used makes the invention useful as an aid to swimming instruction for children. The thermal insulating properties of the foam are useful for sledding and skiing. For older children, the conventional look of the hat has been found to be more appealing to image-conscious adolescents than traditional protective helmets, and the present protective hat is believed to be more comfortable to wear than traditional helmets. For adults, the present hat is a comfortable, lightweight, safe alternative to unsightly protective helmets in current use in a number of applications related to problems associated with aging.

It will be understood that the protective hats set forth above are substantially soft foam protective hats adapted to provide all of the advantages and protection available from soft foam protective hats. It will be also be understood that for certain applications the advantages and protection of a substantially hard protective helmet are desired. Unfortunately, the disadvantages associated with such hard protective helmets, are then incurred. These disadvantages can include, for example difficulty in fitting the protective device to the head of the user, the discomfort of having a hard surface in proximity to the head of the user, sliding around of the helmet on the head, and, in some cases, the weight of the helmet. Thus it is desirable to provide the advantages and protection of a substantially hard protective helmet while avoiding the disadvantages.

The protective helmet of the present invention is therefore adapted to bridge the gap between hard and soft headwear and thereby provide many of the advantages of both hard and soft protective headwear devices. In order to provide such protective headwear the present invention provides a relatively hard rigid foam outer core layer in combination with a relatively soft foam inner core layer, wherein the foam materials of the outer and inner core layers have substantially different cell structures.

The material of the relatively soft inner core layer can be substantially as previously described with respect to cores 20, 28, for example, Ensolite, type AA. The harder outer core layer is formed of a material suitable for absorbing most of the force of impacts without cracking rather than transferring the force to the head of the user. For example, the material of the hard outer core layer can be a material such as Ensolite HH. This material is a cross-linked polymer capable of withstanding repeated impact/recovery cycles, and has a density of between about 9.0 and 12.0 lbs./cu. ft., a thermal conductivity of 0.30, a 25% compression resistance of 22.0 to 35.0, a 50% compression set, maximum, of 15%, a maximum linear shrinkage of 3.0%. a minimum tensile strength of 150 lb./sq. in., and a minimum cold crack of −20 degrees F. Other equivalent foams can also be used. The hard and soft foams can be adhered to each other by an add on adhesive, by heat bonding, or by any other means. Alternately, the hard and soft foams can be encased with each other without being joined to each other.

While the material of the hard outer core layer is extremely dense and rigid, it is pliable and it conforms to the head of the user, thereby providing a safe fit for the user. The pliable and conformal qualities of the hard outer core layer are at least in part provided by the formation of slits and holes through both the inner and outer core layers as previously described. The hard foam material is lighter than plastic and therefore more comfortable for the user than plastic.

The dual hard/soft core layers of the present invention can be encased with materials substantially as described above. They can be encased in interchangeable fabric casings or pockets, in a range of textile fabrics, knitted goods, velvet-like goods, and water resistant and water-proof fabrics, such as Gore-tex, to allow for a wide range of uses. Additionally, the headwear formed of the hard and soft core layers can be further customized since it can be formed of individualized sections that can be stitched together.

Because of the dual hard/soft structure of the protective headwear of the present invention it is approximately sixty percent more shock absorbent than prior art soft foam headwear having substantially the same dimensions or weight. The headwear of the present invention is therefore suitable for many severe medical applications such as the protection of patients after head surgery and protection of patients having Parkinson's disease and Huntington's chorea. It is also useful for preventing plagiocephaly among infants sleeping on their backs in order to prevent sudden infant death syndrome. Additionally, it is suitable for many potentially dangerous sporting activities such soccer and skiing.

Therefore, referring to FIG. 10, there is shown the dual foam structure of the present invention. As described, the dual foam structure includes a relatively softer inner layer 100 and a relatively harder outer layer 98, as shown.

The present invention may be embodied in other specific forms without departing from its spirit or essential attributes. Accordingly, reference should be made to the appended claims rather than the foregoing specification and accompanying drawings for an indication of the scope of the invention.

I claim:

1. A protective hat having shock absorbing and insulating properties, comprising a head-receiving member adapted to overlie and protect at least the sides, top and rear of the head of a wearer, said head-receiving member comprising a core of resilient shock absorbent polymeric foam material and a shell of textile fabric material, said shell being so constructed and arranged as to fully enclose and encapsulate said core so that said hat has a conventional appearance and surface texture, said core comprising first and second core layers, said first core layer being formed of a closed cell foam material having a thickness of about ⅛ to about ¾ inch and said second core layer being formed of a closed cell foam material of higher compression resistance than said first core layer having a thickness of about ⅛ to about ⅜ inch, said core having a plurality of spaced holes therethrough distributed over the surface of said core to facilitate ventilation of said head-receiving member, and said core having a plurality of slits therethrough, said slits being disposed between said holes to facilitate conformity of said core to the shape of the head of a user and to further facilitate ventilation of said head-receiving member.

2. A hat according to claim 1, wherein said head-receiving member comprises an arcuate member adapted to partly encircle the head of a wearer and at least one closure member, said closure member having edge portions complementary with and fixedly coupled to respective edge portions of said arcuate member.

3. A hat according to claim 2, wherein said closure member comprises a side piece having a core of resilient shock absorbent foam material and a shell of textile fabric material, said shell being so constructed and arranged as to fully enclose and encapsulate said core of said side piece, said core comprising first and second core layers, said first core layer being formed of a closed cell foam material having a thickness of about ⅛ to about ¾ inch and said second core layer being formed of a closed cell foam material of higher compressive strength than said first core layer having a thickness of about ⅛ to about ⅜ inch.

4. A hat according to claim 1, wherein said closed cell foam material consists of a cross-linked polymer of modified PVC and nitrile rubber.

5. A hat according to claim 1, wherein said foam material forming said first core layer has a 25% compression resistance of 5.0 to 7.0 psi at 70° F.

6. A hat according to claim 1, wherein said first core layer has a thickness of about ⅛ to about ⅜ inches.

7. A hat according to claim 1, wherein said foam material forming said second core layer has a 25% compression resistance of 22.0 to 35.0 psi at 70° F.

8. A hat according to claim 1, wherein said second core layer has a thickness of about ¼ to about ⅜ inches.

* * * * *